US011333139B2

(12) United States Patent
Liu et al.

(10) Patent No.: US 11,333,139 B2
(45) Date of Patent: May 17, 2022

(54) CRYOPUMP

(71) Applicants: BOE TECHNOLOGY GROUP CO., LTD., Beijing (CN); ORDOS YUANSHENG OPTOELECTRONICS CO., LTD., Inner Mongolia (CN)

(72) Inventors: Jindong Liu, Beijing (CN); Qingwu Kong, Beijing (CN); Xiongfei Guo, Beijing (CN)

(73) Assignees: BOE TECHNOLOGY GROUP CO., LTD., Beijing (CN); ORDOS YUANSHENG OPTOELECTRONICS CO., LTD., Inner Mongolia (CN)

( * ) Notice: Subject to any disclaimer, the term of this patent is extended or adjusted under 35 U.S.C. 154(b) by 652 days.

(21) Appl. No.: 16/305,730

(22) PCT Filed: Mar. 7, 2018

(86) PCT No.: PCT/CN2018/078256
§ 371 (c)(1),
(2) Date: Nov. 29, 2018

(87) PCT Pub. No.: WO2019/007093
PCT Pub. Date: Jan. 10, 2019

(65) Prior Publication Data

US 2021/0222685 A1 Jul. 22, 2021

(30) Foreign Application Priority Data

Jul. 3, 2017 (CN) ..... 201720798098.9

(51) Int. Cl.
*F04B 37/08* (2006.01)

(52) U.S. Cl.
CPC ..... *F04B 37/08* (2013.01)

(58) Field of Classification Search
CPC ..... F04B 37/08
See application file for complete search history.

(56) References Cited

U.S. PATENT DOCUMENTS 4,356,701 A * 11/1982 Bartlett ..... F04B 37/08 165/104.21
4,718,241 A * 1/1988 Lessard ..... F04B 37/08 417/901

(Continued)

FOREIGN PATENT DOCUMENTS

CN 102686880 A 9/2012
CN 102734124 A 10/2012

(Continued)

OTHER PUBLICATIONS

PCT International Search Report, Application No. PCT/CN2018/078256, dated Jun. 14, 2018, 7 pages: with English translation.

(Continued)

*Primary Examiner* — Lionel Nouketcha
(74) *Attorney, Agent, or Firm* — Armstrong Teasdale LLP

(57) ABSTRACT

The embodiments of the present disclosure relates a cryopump including a pump housing including a suction port, a cold head located within the pump housing, a shielding element located within the pump housing and covering the cold head, a baffle at the suction port, the baffle including a gas passage with an inlet and an outlet, an orthographic projection of the baffle to the cross section of the pump housing completely covers an orthographic projection of the suction port thereto, the gas passage includes a first portion and a second portion intersecting with each other, the inlet is defined by one end of the first portion, the outlet is defined by one end of the second portion.

17 Claims, 3 Drawing Sheets

(56) References Cited

U.S. PATENT DOCUMENTS

| | | | | | |
|---|---|---|---|---|---|
| 4,791,791 | A * | 12/1988 | Flegal | F04B 37/08 | 417/901 |
| 5,000,007 | A * | 3/1991 | Haefner | F04B 37/08 | 417/901 |
| 6,155,059 | A * | 12/2000 | Matte | F04B 37/08 | 62/55.5 |
| 2007/0283704 | A1 * | 12/2007 | Tanaka | F04B 37/08 | 62/55.5 |
| 2012/0260675 | A1 * | 10/2012 | Fukuda | F04B 37/02 | 62/55.5 |

FOREIGN PATENT DOCUMENTS

| | | | |
|---|---|---|---|
| CN | 102777345 | A | 11/2012 |
| CN | 103994050 | A | 8/2014 |
| CN | 105715510 | A | 6/2016 |
| CN | 106438276 | A | 2/2017 |

OTHER PUBLICATIONS

PCT Written Opinion, Application No. PCT/CN2018/078256, dated Jun. 13, 2018, 4 pages.: with English translation of relevant part.

* cited by examiner

CRYOPUMP

CROSS REFERENCE TO RELATED APPLICATIONS

This patent application is a National Stage Entry of PCT/CN2018/078256 filed on Mar. 7, 2018, which claims the benefit and priority of Chinese Patent application No. 201720798098.9 filed on Jul. 3, 2017, the disclosures of which are incorporated herein by reference in their entirety as part of the present application.

BACKGROUND

The embodiments of the present disclosure relate to a cryopump.

In actual production, some products, such as a display screen, need to be fabricated and used in a vacuum environment, and the vacuum environment required to fabricate these products is achieved by means of a cryopump.

By withdrawing the gas in a vacuum chamber and cooling and adsorbing the gas within in the cryopump, the vacuum chamber of the cryopump may reach a desired vacuum state. Therefore, a primary part of the cryopump is an internal cold head therein. Only when the temperature of the cold head is lower than 15K, $H_2$, He and other gases can be secured on a cold umbrella outside the cold head to maintain the vacuum environment of the vacuum chamber. Since a heat radiation of the vacuum chamber will affect the temperature of the cold head, the greater the heat radiation (especially the evaporation of organic materials with higher temperature), the more difficult the temperature of the cold head to maintain, if the temperature of the cold head rises to 15K, the cold head will fail to make it impossible to maintain the vacuum state of the vacuum chamber.

BRIEF DESCRIPTION

An embodiment of the present disclosure provides a cryopump including a pump housing including a suction port, a cold head located within the pump housing, a shielding element located within the pump housing and covering the cold head, a baffle disposed at the suction port, the baffle including a gas passage with an inlet and an outlet, an orthographic projection of the baffle to the cross section of the pump housing completely covers that of the suction port to the cross section of the pump housing, and the gas passage including a first portion and a second portion intersecting with each other, said inlet is defined by one end of the first portion, said outlet is defined by one end of the second portion.

According to some embodiments of the present disclosure, the baffle includes a plurality of first baffle elements disposed on the pump housing, and a plurality of second baffle elements disposed on the pump housing, the plurality of first baffle elements and the plurality of second baffle elements are arranged in a staggered manner, each of the first baffle members and one second baffle member adjacent thereto defining a gas passage.

According to some embodiments of the present disclosure, the gas passage further includes a transition portion, through which the other end of the first portion is communicated with the other end of the second portion.

According to some embodiments of the present disclosure, the plurality of first baffle members and the plurality of second baffle members are in form of annular, respectively.

According to some embodiments of the present disclosure, the plurality of first baffle members and the plurality of second baffle members are in form of strip, respectively.

According to some embodiments of the present disclosure, the baffle includes a plurality of spaced passage groups, each including two gas passages, the first portions of the two gas passages of each passage group being spaced apart by one of the second baffle members, the second portions of the two gas passages of each passage group being in communication with each other.

According to some embodiments of the present disclosure, the height of each of the second baffle members is less than or equal to that of each of the first baffle members.

According to some embodiments of the present disclosure, one end of each of the second baffle members is flush with one end of each of the first baffle members.

According to some embodiments of the present disclosure, in the longitudinal section of the pump housing, each of the first baffle members includes two sub-stoppers interconnected with each other with cross-sectional areas tapering toward each other.

According to some embodiments of the present disclosure, each of the sub-stoppers has a triangular longitudinal section, and each of the second baffle members has a triangular or square longitudinal section.

BRIEF DESCRIPTION OF THE DRAWINGS

The above and/or additional aspects and advantages of the present disclosure will be apparent and readily understood from the embodiments illustrated below with reference to the drawings, in which.

DETAILED DESCRIPTION

Figure 1:
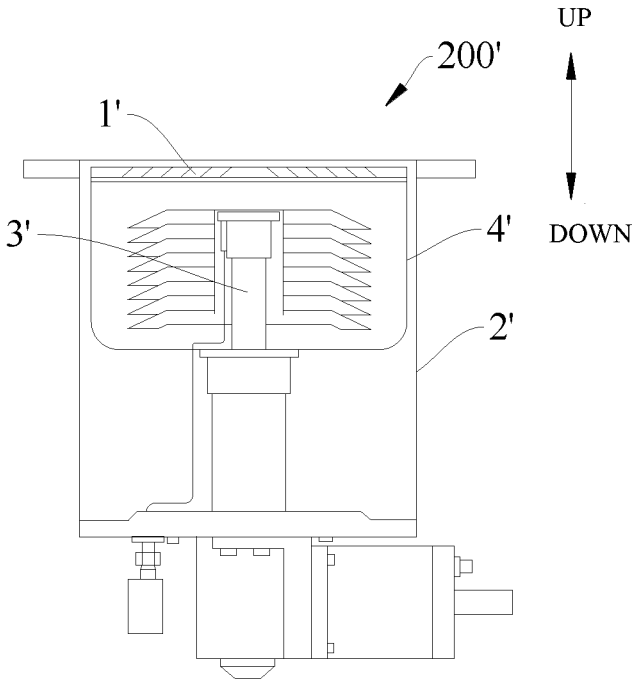
FIG. 1 (PRIOR ART)
FIG. 1 is a longitudinal sectional view of a cryopump in prior art.

The embodiments of the present disclosure will be illustrated in detail below, examples of which are shown in the drawings, wherein the same or like reference numerals will be used to refer to the same or like elements or elements with the same or similar functions. The embodiments described below with reference to the accompanying drawings are exemplary only, and shall be only for the purpose of interpreting but not for limiting the present disclosure.

In the description of the present disclosure, it should be understood that the terms "center", "longitudinal", "transverse", "height", "upper", "lower", "left", "right", "horizontal", "inner", "outer" and etc. refer to orientation or positional relationship shown in the drawings, and are merely for the convenience of illustration and simplification, but do not intend to indicate or imply that a device or component referred to must have a particular orientation, or must be produced and operated in a particular orientation, and therefore shall not to be interpreted as restrictions to the present disclosure. Furthermore, features defined by "first" and "second" may include one or more of the features, either explicitly or implicitly. In the description of the present disclosure, the term "a plurality of" means two or more unless otherwise stated.

In the description of the present disclosure, it should be noted that the terms "mount", "communicate", and "connect", unless otherwise explicitly stipulated and defined, shall be understood in a broad sense, for example, fixed connection, removable connection or integral connection, or mechanical connection, electrical connection, direct connection, or connection via a medium or internal communication between two elements. For a person of ordinary skill in the art, specific meanings of the above terms in the present disclosure can be understood under a specific circumstance.

In techniques known to the inventor(s), as shown in FIG. 1, the baffles 1' (i.e., the 80K baffle) of a cryopump 200' have a substantially oblique longitudinal section, and located at a suction port of a pump housing 2'. The baffles 1' are spaced apart, with gaps therebetween through which heat radiation in a vacuum chamber passes directly from top to bottom to enter into the cryopump 200' via the suction port, resulting in temperature rise of a cold head 3' in a shielding element 4', so that the cryopump 200' cannot condense gas to make it impossible to reach a required vacuum degree in the vacuum chamber.

The cryopump of the present embodiment will be schematically illustrated below with reference to FIGS. 2-8.

The present embodiment provides a cryopump including a pump housing, a cold head, a shielding element, and a baffle 1, wherein the pump housing has a suction port, wherein the cold head is located within the pump housing, wherein the shield element located within the pump housing and covers the cold head, wherein the baffle 1 is disposed at the suction port, the baffle 1 includes a gas passage 10 having an inlet 101*a* and an outlet 102*a*, an orthographic projection of the baffle 1 to the cross section of the pump housing completely covers that of the suction port to the cross section of the pump housing, the gas passage 10 includes a first portion 101 and a second portion 102 intersecting with each other, one end of the first portion 101 defines said inlet 101*a*, and one end of the second portion 102 defines said outlet 102*a*.

The cryopump may include a two-stage cooling structure including a primary cooling structure and a secondary cooling structure, wherein the primary cooling structure may include the shielding element and the baffle 1 and the secondary cooling structure may include the cold head and a cold umbrella assembly.

The pump housing may define a receiving space therein in which the cold head and the shielding element are disposed, the suction port may be formed in upper part of the pump housing and may be in form of circular. The cold head may be provided with the cooling umbrella assembly for condensing and adsorbing gas. The shielding element may be substantially in form of a cylinder, of which the top is open. The baffle 1 is located above the shielding element to cover the suction port, so that the gas flows through the first portion 101 and the second portion 102 in sequence only via the gas passage 10 into the pump housing.

The vacuum chamber may communicate with the interior of the pump housing through the gas passage 10. When the cryopump is in operation, the shielding element, the baffle 1, the cold head, and the cold umbrella assembly are kept at a cryogenic state. The gas flows from the vacuum chamber into the cryopump through the gas passage 10, firstly subjects to the primary cooling in which some gas composition such as water vapor in the gas can be condensed and removed, and then subjects to the second cooling to further condense $H_2$, He, etc., thereby creating a vacuum state in the vacuum chamber.

The vacuum chamber, due to higher temperature thereof, generates heat radiation. The orthographic projection of the baffle 1 to the cross section of the pump housing completely covers the orthographic projection of the suction port to the cross section of the pump housing, and the gas passage 10 includes the first portion 101 and the second portion 102 intersecting with each other, such that the heat radiation cannot pass through the baffle 1 directly via the gas passage 10 to enter the cryopump and the heat radiation will be reflected at least once by the baffle 1, thereby reducing direct radiation of heat in the vacuum chamber to the interior of the cryopump. As a result, the cryogenic pump, especially the cold head, is kept in a cryogenic state, which improves the pumping capacity of the cryopump, and prolongs the service life of the cryopump by well maintenance.

The baffle 1 may be a stainless steel member with a smooth surface, so that the baffle 1 can better reflect the heat radiation of the vacuum chamber, maintain the cryogenic state in the cryopump, and avoid a temperature rise of the baffle 1 due to a non-smooth surface of the baffle 1 which may easily absorb the heat radiation, which will affects the normal operation of the cryopump, thereby improving the pumping capacity of the cryopump.

According to the cryopump of the present embodiment, the baffle 1 is arranged such that the orthographic projection of the baffle 1 to the cross section of the pump housing completely covers the orthographic projection of the suction port thereto, and the gas passage 10 on the baffle 1 includes the first portion 101 and the second portion 102 intersecting with each other to prevent the heat radiation of the vacuum chamber from passing through the baffle 1 directly through the gas passage 10, to maintain the cryopump in a cryogenic state, which improves the pumping capacity of the cryopump while maintaining the cryopump and prolonging the service life of the cryopump.

In some embodiments, as shown in FIGS. 2-6, the first portion 101 may be an upper portion of the gas passage 10, and may extend obliquely from the top to the bottom, at an upper end of which first portion 101 the inlet 101*a* is disposed.

In some embodiments, as shown in FIGS. 2-6, the second portion 102 may be a lower portion of the gas passage 10, and may extend obliquely from the top to the bottom, at a lower end of which second portion 102 the outlet 102*a* is disposed, a lower end of the first portion 101 intersects and communicates with an upper end of the second portion 102.

In the cryopump of the embodiment of the present disclosure, the gas passage 10 is of a simple structure and can be processed easily. Of course, the gas passage 10, not limited to this, may also have other regular or irregular shapes.

In some embodiments of the present disclosure, the baffle 1 includes a plurality of first baffle members 11 disposed on the pump housing, and a plurality of second baffle members 12 disposed on the pump housing and arranged in a staggered manner with the first baffle members 11, each of the first baffle members 11 and an adjacent second baffle member 12 defines the gas passage 10.

For example, as shown in FIGS. 2-8, a second baffle member 12 is disposed between every two adjacent first baffle members 11, and a second baffle member 12 is disposed between every two adjacent second baffle members 12. Each of the first baffle members 11 and one second baffle member 12 adjacent thereto are spaced apart such that the gas passage 10 is defined therebetween. Thus, the structures of the first baffle members 11 and the second baffle members 12 can be simplified for easy processing by configuring the baffle 1 as the plurality of first baffle members 11 and the plurality of second baffle members 12 are arranged in a staggered manner. At the same time, a space distance between each of the first baffle member 11 and one second baffle member 12 adjacent thereto may be adjusted conveniently, so as to adjust the cross-sectional area of the gas passage 10, thereby improving an effective pumping area of the cryopump to increase the pumping capacity of the cryopump.

In some embodiments of the present disclosure, the space distance between each of the first baffle members 11 and each of the second baffle members 12 is adjusted such that one end of each of the second baffle member 12 (e.g., the left end in FIGS. 2-6) is flush with one end of the first baffle member 11 (e.g., the right end in FIGS. 2-6) adjacent to the end of said second baffle member 12 in a left-right direction, and the other end of each of the second baffle member 12 (e.g., the right end in FIGS. 2-6) is flush with said one end of the first baffle member 11 (e.g., the left end in FIGS. 2-6) adjacent to the other end of said second baffle member 12 in a left-right direction, and such that that the cross section of the baffle 1 just completely covers the suction port. In this case, a maximum space distance between each of the first baffle members 11 and one second baffle member 12 adjacent thereto is created, and the gas passage 10 has a maximum cross-sectional area, which means that the cryopump exhibits a maximum effective suction area and therefore improves the pumping capacity of the cryopump considerably.

It should be understood that the number of the first baffle members 11 and the second baffle members 12 may be selected according to actual conditions, and meanwhile the plurality of first baffle members 11 and the plurality of second baffle members 12 may be disposed on the shielding element. Of course, the baffle 1 may be a one-piece member to reduce the number of parts.

In some embodiments of the present disclosure, the gas passage 10 further includes a transition portion (not shown), through which the other end of the first portion 101 is connected to the other end of the second portion 102. When the inlet 101*a* is at the upper end of the first portion 101 and the outlet 102*a* is at the lower end of the second portion 102, the lower end of the first portion 101 may communicate with the upper end of the second portion 102 via the transition portion to create more stable gas flow and to reduce vibration of the cryopump.

In some embodiments of the present disclosure, the plurality of first baffle members 11 and the plurality of second baffle members 12 have annular forms, respectively, which can be realized easily with a simple structure.

Figure 7:
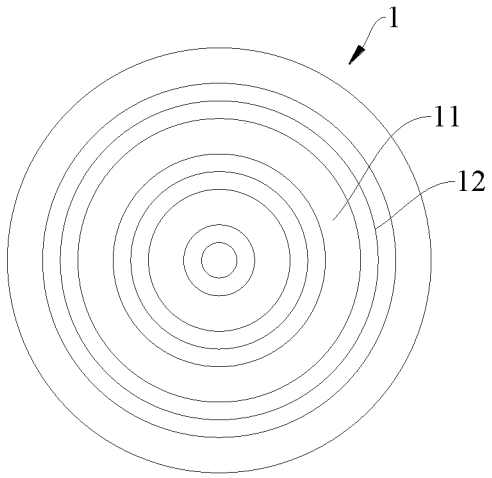
FIG. 7 is a top view of a baffle of a cryopump according to some embodiments of the present disclosure.

As shown in FIG. 7, for example, the baffle 1 may be substantially in a circular form that fits the shape of the suction port. The plurality of first baffle members 11 are concentric circular rings with different radii respectively, and the second baffle members 12 are concentric rings with different radii respectively. The plurality of first baffle members 11 and the plurality of second baffle members 12 are arranged sequentially in a staggered manner at the suction port from inside to outside so that the orthographic projection of the baffle 1 to the cross section of the pump housing completely covers the orthographic projection of the suction port thereto.

Here, it should be noted that the direction "inner" refers to a direction approximate to a central axis of the cryopump, and the opposite direction is defined as "outer". It can be understood that the plurality of first baffle members 11 may be annular members with different shapes, and the plurality of second baffle members 12 may also be annular members with different shapes. If the baffle 1 is of other shapes, the plurality of first baffle members 11 and the plurality of second baffle members 12 may be annular members of other shapes, respectively.

In some embodiments of the present disclosure, the plurality of first baffle members 11 and the plurality of second baffle members 12 are in form of strip respectively, which can be realized easily with a simple structure as well.

Figure 8:
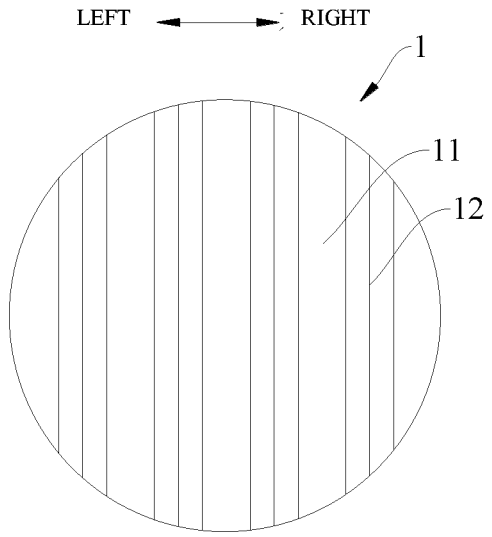
FIG. 8 is a top view of a baffle of a cryopump according to some embodiments of the present disclosure.

As shown in FIG. 8, for instance, the suction port also is in form of a circular, while the plurality of first baffle members 11 are strip structures of different sizes respectively, and the plurality of second baffle members 12 are embodied as strip structures of different sizes respectively. The plurality of first baffle members 11 and the plurality of second baffle members 12 are staggered from one side of the suction port (e.g., the left side in FIG. 8) to the other side thereof (e.g., the right side in FIG. 8) sequentially such that the orthographic projection of the baffle 1 to the cross section of the pump housing completely covers the orthographic projection of the suction port thereto.

Alternatively, the plurality of first baffle members 11 and the plurality of second baffle members 12 may be of other regular or irregular structures, as long as the orthographic projection of the first baffle members 11 and the plurality of second baffle members 12 arranged in staggered manner to the cross section of the pump housing completely cover the orthographic projection of the suction port thereto. Of course, the shapes of the plurality of first baffle members 11 may be different from each other, and the plurality of second baffle members 12 may be different from each other in shape as well.

In some embodiments of the present disclosure, the baffle 1 includes a plurality of spaced passage groups 100, each includes two gas passages 10, the first portions 101 of the two gas passages of each passage group are separated from each other by one second baffle member, the second portions of the two gas passages 10 of each passage group 100 are in communication with each other.

For example, as shown in FIGS. 2-4 and 6, a passage group 100 may include two gas passages 10 between two adjacent first baffle members 11. The second baffle members 12 are offset from the central cross-section of the baffle 1 upward such that the first portions 101 of the two gas passages 10 are separated from each other by one second baffle member 12 and the second portions 102 of the two gas passages 10 are communicated with each other, thereby saving the material of the second baffle members 12 to reduce cost.

The height of each of the second baffle members 12 may be less than or equal to that of each of the first baffle members 11 to reduce space occupied by the second baffle member 12.

Figure 3:
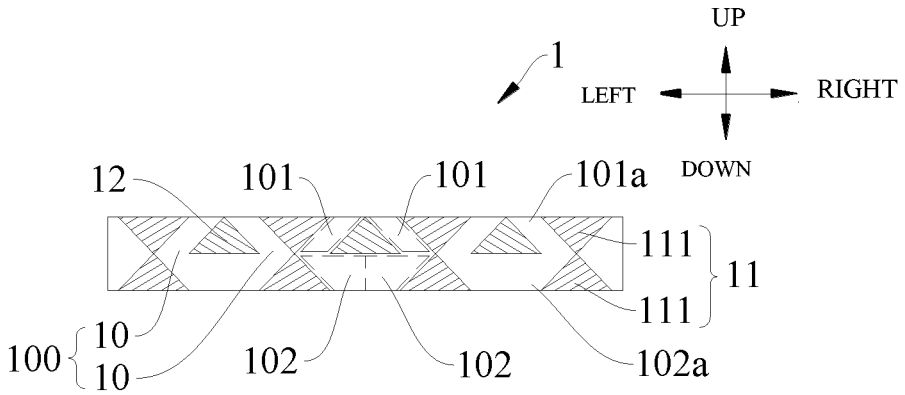
FIG. 3 is a partial cross-sectional schematic view of a baffle of a cryopump according to some embodiments of the present disclosure.
Figure 4:
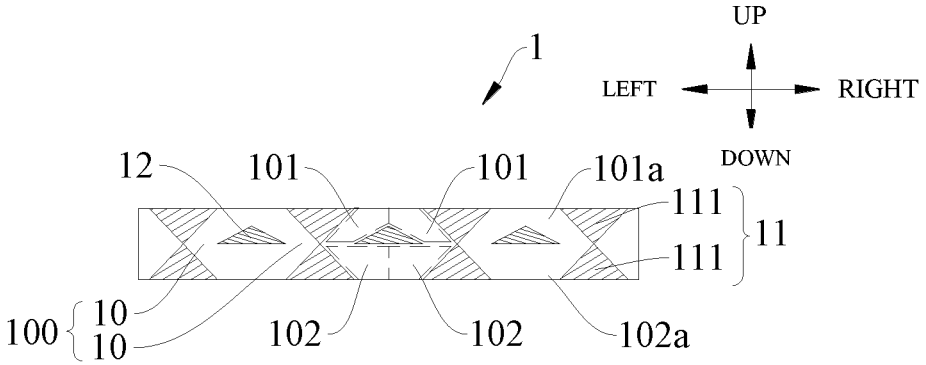
FIG. 4 is a partial cross-sectional schematic view of a baffle of a cryopump according to some embodiments of the present disclosure.
Figure 5:
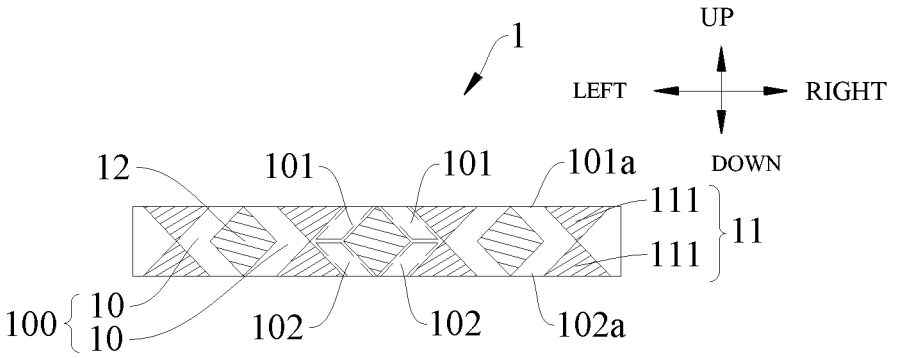
FIG. 5 is a partial cross-sectional schematic view of a baffle of a cryopump according to some embodiments of the present disclosure.

For example, as shown in FIG. 5, the height of each of the second baffle members 12 is equal to that of each of the first baffle members 11 in an up-down direction; in the examples of FIGS. 2-4 and 6, in the up-down direction, the height of each of the second baffle members 12 is smaller than that of each of the first baffle members 11. Of course, the height of each of the second baffle members 12 may be greater than that of each of the first baffle members 11.

Figure 2:
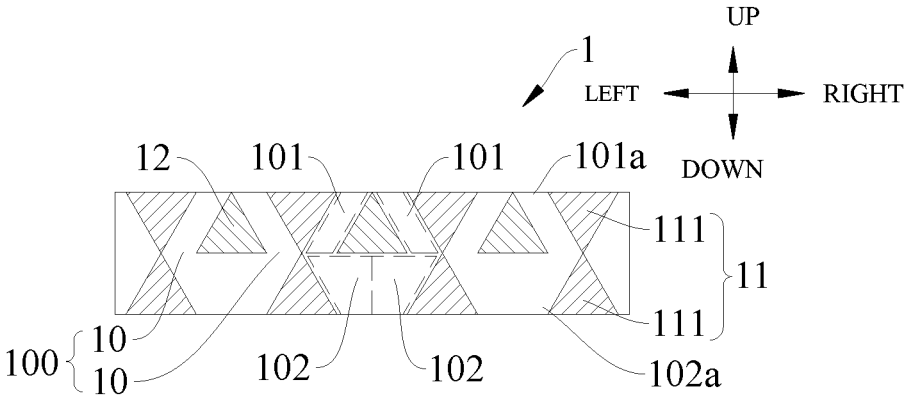
FIG. 2 is a partial cross-sectional schematic view of a baffle of a cryopump according to some embodiments of the present disclosure.

For example, as shown in FIGS. 2 and 3, in the up-down direction, the height of each of the second baffle members 12 may be one-half of the height of each of the first baffle members 11; as shown in FIG. 4, in the up-down direction, the height of each of the second baffle members 12 may be one quarter of the height of each of the first baffle members 11. But, it is not limited to these. Thereby, the orthographic projection of the baffle 1 to the cross section of the pump housing completely covering the orthographic projection of the suction port thereto saves the material for the second baffle members 12 and decreases the space occupied thereby, thus increasing effective pumping area of the cryopump and pumping speed to improve pumping efficiency of the cryopump.

In some embodiments of the present disclosure, one end of each of the second baffle members 12 is flush with one end of each of the first baffle members 11 to facilitate installation of the first baffle members 11 and the second baffle members 12.

For example, referring to FIGS. 2 and 3, the upper end of each of the second baffle members 12 is flush with the upper end of each of the first baffle members 11, and the lower end of each of the second baffle members 12 is staggered from the lower end of each of the first baffle members 11.

For example, referring to FIG. 5, the upper and lower ends of each of the second baffle members 12 are flush with the upper and lower ends of each of the first baffle members 1 respectively.

Alternatively, the lower end of each of the second baffle members 12 may be flush with the lower end of each of the first baffle members 11, and the upper end of each of the second baffle members 12 is staggered from the upper end of each of the first baffle members 11.

In some embodiments of the present disclosure, either of the two ends of each of the second baffle members 12 is staggered from either of the two ends of each of the first baffle members 11.

Figure 6:
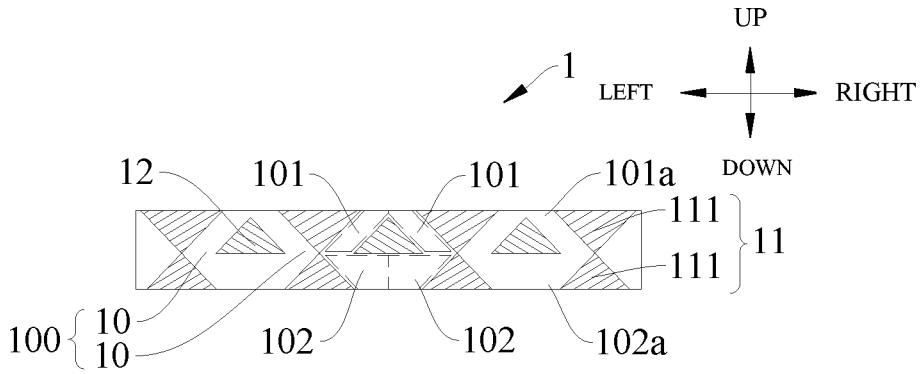
FIG. 6 is a partial cross-sectional schematic view of a baffle of a cryopump according to some embodiments of the present disclosure.

For example, as shown in FIGS. 4 and 6, the upper and lower ends of each of the second baffle members 12 are staggered from the upper and lower ends of each of the first baffle members 11, such that the height of each of the second baffle members 12 is less than that of each of the first baffle members 11, thereby further saving the material of the second baffle members 12, reducing the space occupied by the second baffle members 12, which increases the effective pumping area of the cryopump considerably, improves pumping speed and then enhances the pumping efficiency of the cryopump.

In some embodiments of the present disclosure, referring to FIGS. 2-6, in the longitudinal section of the pump housing, a maximum area of the cross-section of each of the second baffle members 12 is flush with a minimum area of the cross-section of each of the first baffle members 11, such that the cross-sectional area of the gas passage 10 is increased to improve effective pumping area of the cryopump on the cross-section of the pump housing under the premise that the orthographic projection of baffle 1 to the cross section of the pump casing completely covers the orthographic projection of suction port thereto.

In some embodiments of the present disclosure, referring to FIGS. 2-4 and 6, the maximum area of the cross-section of each of the second baffle members 12 is at the lower end thereof, while the minimum area of the cross-section of each of the first baffle members 11 at the middle thereof. The lower end of each of the second baffle members 12 is flush with the middle of each of the first baffle members 11 to improve the effective pumping area of the cryopump.

In some embodiments of the present disclosure, referring to FIG. 5, the maximum area of the cross-section of each of the second baffle members 12 is at the middle thereof, while the minimum area of the cross-section of each of the first baffle members 11 is at the middle thereof. The middle of each of the second baffle members 12 is flush with the middle of each of the first baffle members 11 to improve the effective pumping area of the cryopump.

In some embodiments of the present disclosure, in the longitudinal section of the pump housing, each of the first baffle members 11 includes two sub-stoppers 111 interconnected with each other with cross-sectional areas tapering toward each other.

For example, as shown in FIGS. 2-6, the two sub-stoppers 111 are connected vertically, with the cross-sectional areas thereof tapering toward each other. In other words, the cross-sectional area of each of the first baffle members 11 decreases first and then increases from top to bottom, so that the extending direction of the gas passages 10 defined between each of the first baffle members 11 and the corresponding second baffle member 12 may change at a junction of the two sub-stoppers 111 to prevent the heat radiation of the vacuum chamber from directly passing through the baffle 1 directly via the gas passage 10, thus affecting the temperature in the cryopump, especially the temperature of the cold head, and reducing direct radiation of the vacuum chamber to the cryopump.

In some embodiments of the present disclosure, as shown in FIGS. 2-6, each sub-stopper 111 has a triangular longitudinal section, and each of the second baffle members 12 has a triangular or square longitudinal section.

For instance, the longitudinal sections of each of the sub-stoppers 111 may be an isosceles triangle, and the longitudinal section of each of the second baffle member 12 may be an isosceles triangle or a parallelogram. Alternatively, the sub-stoppers 111 in each case may have longitudinal sections of other shapes, such as right triangles, etc., and furthermore the longitudinal sections of the sub-stoppers 111 may not be identical in shape and size. The second baffle members 12 may have a longitudinal section of a quadrilateral of other shapes, such as a trapezoid or the like. Hence, the sub-stoppers 111 and the second baffle members 12 have longitudinal sections of regular shapes, that is, the shapes of the sub-stoppers 111 and the second baffle members 12 are regular for the sake of convenient processing.

It should be understood that the longitudinal section of each of the sub-stoppers 111 may have other regular or irregular shapes, and the longitudinal section of each of the second baffle members 12 may have other regular or irregular shapes. Hence, the shapes of the sub-stoppers 111 and the second baffle members 12 are various, which enhances the diversity of the baffle 1 so that the baffle 1 meets practical applications with excellent applicability.

In some embodiments of the present disclosure, as illustrated in FIG. 2, the baffle 1 includes a plurality of first baffle members 11 and a plurality of second baffle members 12 arranged in a staggered manner, an upper end of each of the second baffle members 12 is flush with an upper end of each of the first baffle members 11, each of the first baffle members 11 and one second baffle member 12 adjacent thereto define the gas passage 10 including a first portion 101 and a second portion 102 interconnected with each other, the inlet 101*a* of the gas passage 10 is at the upper end of the first portion 101, and the outlet 102*a* of the gas passage 10 is at the lower end of the second portion 102, wherein, each of the first baffle members 11 includes two interconnected sub-stoppers 111, and the first portion 101 is defined between the upper sub-portion 111 and one second baffle member 12.

The longitudinal sections of the sub-stoppers 111 may be equilateral triangles with the same size. The two sub-stoppers 111 of each of the first baffle members 11 are opposed to each other vertically such that an upper edge of the upper sub-stopper 111 and a lower edge of the lower sub-stopper 111 are parallel to each other and within a horizontal plane. The longitudinal section of each of the second baffle member 12 is an equilateral triangle, with the same size as the longitudinal section of the lower sub-stopper 111. In other words, the height of each of the second baffle members 12 is one-half of the height of each of the first baffle members 11 in the vertical direction such that the second portions 102 of the two gas passages 10 between adjacent two first baffle members 11 are in communication, and at the same time, the junction between the upper sub-stopper 111 and the lower sub-stopper 111 is flush with the lower edge of each of the second baffle members 12 in the vertical direction, which means that a minimum area of the cross-section of each of the first baffle members 11 is flush with a maximum area of the cross-section of each of the second baffle members 12 in the vertical direction to increase the effective pumping area of the cryopump and improve the pumping capacity thereof.

The space distance between each of the first baffle members 11 and each of the second baffle members 12 is adjusted such that the left end of each of the second baffle members 12 is flush with the right end of the first baffle member 11 adjacent to the left end of said second baffle member 12 in the left-right direction, and the right end of each of the second baffle members 12 is flush with the left end of the first baffle member 11 adjacent to the right end of said second baffle member 12 in the left-right direction. In this case, the orthographic projection of the baffle 1 to the cross section of the pump housing completely covers the orthographic projection of the suction port thereto to increase the cross-sectional area of the gas passage 10 under the premise of preventing the heat radiation of the vacuum chamber directly passing through the baffle 1, thereby improving pumping capacity of the cryopump.

The plurality of first baffle members 11 and the plurality of second baffle members 12 may be in form of annular (e.g., as shown in FIG. 7), and are sequentially staggered from inside to outside to cover the suction port. Alternatively, the plurality of first baffle members 11 and the plurality of second baffle members 12 may be in form of a strip (e.g., as shown in FIG. 8), and are sequentially staggered from one side of the suction port to the other side of the suction port, so that the orthographic projection of the baffle 1 to the cross section of the pump housing covers the suction port thereto. But, it is not limited to these.

In some embodiments of the present disclosure, similar to the configuration shown in FIG. 2, the same components are indicated by the same reference numerals in FIG. 3. In the structure of the cryopump shown in FIG. 3, the longitudinal section of each of the sub-stoppers 111 is an isosceles triangle of the same size (excluding an equilateral triangle), and the longitudinal section of each of the second baffle members 12 is an isosceles triangle with the same size as the lower longitudinal section of the lower sub-stopper 111. The above isosceles triangle can be obtained by reducing the height of the equilateral triangle in the first embodiment and increasing the vertex angle of the equilateral triangle of the first embodiment, so that the material of the second baffle members 12 can be saved without changing the suction port, and the space occupied by the second baffle members 12 can be reduced, thereby further improving the effective pumping area of the cryopump.

In the cryopump shown in FIG. 3, the first baffle members 11 and the second baffle members 12 can be arranged in a manner similar to the first baffle members 11 and the second baffle members 12 shown in FIG. 2, and thus will not be illustrated anymore.

In some embodiments of the present disclosure, similar to the configuration shown in FIG. 2, the same components are indicated by the same reference numerals in FIG. 4. In the cryopump shown in FIG. 4, the junction between the upper sub-stopper 111 and the lower sub-stopper 111 is flush with the lower edge of each of the second baffle members 12. In other words, the height of each of the second baffle member 12 is one quarter of the height of each of the first baffle members 11 on the premise that the minimum area of the cross-section of each of the first baffle member 11 is flush with the maximum area of the cross-section of each of the second baffle member 12 in the vertical direction such that the material of the second baffle members 12 is saved without reducing the strength thereof, and the space occupied by the second baffle members 12 is reduced, thereby improving pumping capacity of the cryopump.

For the cryopump of the configuration shown in FIG. 4, the first baffle members 11 and the second baffle members 12 can be arranged in a manner similar to the first baffle members 11 and the second baffle members 12 shown in FIG. 2, and thus will not be illustrated anymore.

In some embodiments of the present disclosure, similar to the configuration shown in FIG. 2, the same components are indicated by the same reference numerals in FIG. 5. In the cryopump shown in FIG. 5, the longitudinal section of each of the second baffle members 12 is of a diamond shape, so that the second portion 102 is defined between each of the second baffle member 12 and the lower sub-stopper 111, and the second portions 102 of the two gas passages 10 of two adjacent first baffle members 11 are separated from by one second baffle member 12.

The height of each of the second baffle members 12 is equal to the height of each of the first baffle members 11, and the upper and lower ends of each of the second baffle members 12 are flush with the upper and lower ends of each of the first baffle members 11 respectively.

The height of each of the second baffle members 12 may be smaller than the height of each of the first baffle members 11. Then one end of each of the second baffle members 12 may be flush with one end of each of the first baffle members 11, or the upper and lower ends of each of the second baffle members 12 are staggered from the upper and lower ends of each of the first baffle members 11.

In the cryopump shown in FIG. 5, the first baffle members 11 and the second baffle members 12 can be arranged in a manner similar to the first baffle members 11 and the second baffle members 12 shown in FIG. 2, and thus will not be illustrated anymore.

In some embodiments of the present disclosure, similar to the configuration shown in FIG. 2, the same components are indicated by the same reference numerals in FIG. 6. In the cryopump shown in FIG. 5, the upper sub-stopper 111 and the lower sub-stopper 111 are different in size, and the longitudinal section of the upper sub-stopper 111 is larger than that of the lower sub-stopper 111. At this time, the left end of each of the second baffle members 12 is flush with the right end of the lower sub-stopper 111 adjacent thereto in the left-right direction, and the right end of each of the second shutter members 12 is flush with the left end of the lower sub-stopper 111 adjacent thereto in the left-right direction, so that the orthographic projection of the baffle 1 to the cross section of the pump housing completely covers the orthographic projection of the suction port and at the same time the effective pumping area of the cryopump is increased.

The minimum area of the cross-section of each of the first baffle members 11 may be flush with the maximum area of the cross-section of each of the second baffle members 12 in the vertical direction to further increase the effective pumping area of the cryopump.

In the cryopump shown in FIG. 6, the first baffle members 11 and the second baffle members 12 can be arranged in a manner similar to the first baffle members 11 and the second baffle members 12 shown in FIG. 2, and thus will not be illustrated anymore.

Other configurations and operations of the cryopump in accordance with the embodiments of the present disclosure are known to the ordinary skilled in the art and will not be illustrated in detail herein.

In the depiction of the present specification, the reference terms "one embodiment", "some embodiments", "illustrative embodiment", "example", "specific example", or "some examples", etc. mean that the particular features, structures, materials, or characteristics described in the embodiment(s) or example(s) are encompassed within at least one embodiment or example of the present disclosure. In the present disclosure, the illustrative expression of the above terms does not necessarily refer to the same embodiment or example. Furthermore, the particular features, structures, materials, or characteristics described may be combined in a suitable manner in any one or more embodiments or examples.

Although the embodiments of the present disclosure are shown and illustrated, the ordinary skilled in the art may understand that any changes, modifications, substitutions, or variants can be made without departing from the principle and spirit of the present disclosure. The protection of the present disclosure shall be defined by the claims and equivalents thereof.

What is claimed is:

1. A cryopump comprising:

a pump housing including a suction port;

a cold head located within the pump housing;

a shielding element located within the pump housing and covering the cold head; and a baffle disposed at the suction port, wherein the baffle includes a gas passage with an inlet and an outlet, wherein an orthographic projection of the baffle to the cross section of the pump housing completely covers an orthographic projection of the suction port thereto, wherein the gas passage includes a first portion and a second portion intersecting with each other, wherein the inlet is defined by one end of the first portion, and wherein the outlet is defined by one end of the second portion, wherein the baffle comprises:

a plurality of first baffle members disposed on the pump housing, and a plurality of second baffle members disposed on the pump housing, wherein the plurality of first baffle members and the plurality of second baffle members are arranged in a staggered manner, each of the first baffle members and one second baffle member adjacent thereto defining the gas passage, and wherein in the longitudinal section of the pump housing, each of the first baffle members includes two sub-stoppers interconnected with each other, and the cross-sectional areas of two sub-stoppers taper towards each other.

2. The cryopump according to claim 1, wherein the gas passage further comprises a transition portion, through which the other end of the first portion is in communication with the other end of the second portion.

3. The cryopump according to claim 1, wherein the plurality of first baffle members and the plurality of second baffle members have an annular form.

4. The cryopump according to claim 1, wherein the plurality of first baffle members and the plurality of second baffle members have a strip form.

5. The cryopump according to claim 1, wherein the baffle includes a plurality of spaced passage groups, wherein each passage group includes two gas passages, wherein first portions of the two gas passages of each passage group are separated by one said second baffle member, and wherein second portions of the two gas passages of each passage group are in communication with each other.

6. The cryopump according to claim 1, wherein the height of each second baffle member is less than or equal to that of each of the first baffle members.

7. The cryopump according to claim 6, wherein one end of each of the second baffle members is flush with one end of each of the first baffle members.

8. The cryopump according to claim 1, wherein each of the sub-stoppers has a triangular longitudinal section, and wherein each of the second baffle members has a triangular or square longitudinal section.

9. The cryopump according to claim 1, wherein the cryopump comprises a two-stage cooling structure, and wherein the two-stage cooling structure includes i) a primary cooling structure having the shielding element and the baffle and ii) a secondary cooling structure having the cold head and a cold umbrella assembly.

10. The cryopump according to claim 1, wherein the shielding element is in form of a cylinder, and wherein the top of the cylinder is open.

11. The cryopump according to claim 1, wherein the suction port is formed in an upper part of the pump housing and is circular.

12. The cryopump according to claim 1, wherein the baffle is located above the shielding element to cover the suction port.

13. The cryopump according to claim 1, wherein the baffle is a stainless steel member.

14. The cryopump according to claim 1, wherein the baffle is a one-piece member.

15. The cryopump according to claim 1, wherein the first baffle members are concentric circular rings with different radii respectively, and wherein the second baffle members are concentric rings with different radii respectively.

16. The cryopump according to claim 1, wherein one end of each of the second baffle members is flush with one end of each of the first baffle members.

17. The cryopump according to claim 1, wherein the upper and lower ends of each of the second baffle members are flush with the upper and lower ends of each of the first baffle members respectively.

* * * * *